United States Patent [19]

Manlove et al.

[11] 3,961,456

[45] June 8, 1976

[54] MOLDING FOR CABINETS AND DOORS

[76] Inventors: Glen D. Manlove, 1109 S. Sixth Ave., Arcadia, Calif. 91006; Paul K. Ishler, 4334 Ridgewood, El Monte, Calif. 91734

[22] Filed: Aug. 19, 1974

[21] Appl. No.: 498,749

Related U.S. Application Data

[63] Continuation-in-part of Ser. No. 313,775, Dec. 11, 1972.

[52] U.S. Cl. ..... 52/716; 52/758 H; 312/204

[51] Int. Cl.[2] ..... A47B 96/20; E04C 2/38

[58] Field of Search ..... 52/288, 475, 476, 627, 52/656, 716, 717, 758 H; 312/108, 111, 140, 204, 352

[56] References Cited

UNITED STATES PATENTS

| | | | |
|---|---|---|---|
| 1,976,773 | 10/1934 | Conway et al. | 52/476 |
| 2,564,386 | 8/1951 | Webb | 52/716 |
| 2,730,777 | 1/1956 | Koriagin | 52/476 X |
| 3,289,341 | 12/1966 | Howell | 52/758 H X |
| 3,426,482 | 2/1969 | Mock | 52/627 X |
| 3,479,770 | 11/1969 | Mock | 52/627 X |
| 3,603,627 | 9/1971 | Kaffel | 52/758 H |

FOREIGN PATENTS OR APPLICATIONS

| | | | |
|---|---|---|---|
| 694,401 | 9/1964 | Canada | 52/716 |
| 1,311,988 | 10/1961 | France | 312/108 |
| 1,429,466 | 11/1968 | Germany | 312/140 |

*Primary Examiner*—Robert L. Wolfe
*Assistant Examiner*—Carl F. Pietruszka
*Attorney, Agent, or Firm*—Jackson & Jones Law Corporation

[57] ABSTRACT

A plastic molding member is designed to snap or slide onto key hole tongues of either cabinet panel edges or door frames member. The molding permits section blanks of a cabinet panel to be removed and the perimeter of the blank to be covered with the molding which thereby permits it to be utilized as a cabinet door or a decorative panel without any loss of material. In addition, hollow doors can be easily fabricated with the molding member of the present invention. In the preferred cabinet embodiment, the molding consists of a rear flat surface designed to interface with the back of the panel and a front and top surface designed to provide a decorative finish and to overlap the interface of the panel key hole tongue and surface. In an alternative embodiment the upper portion of the molding is hollow and adapted to receive a spring clip to secure two sections of the molding to a panel or door frame.

10 Claims, 7 Drawing Figures

FIG. 1
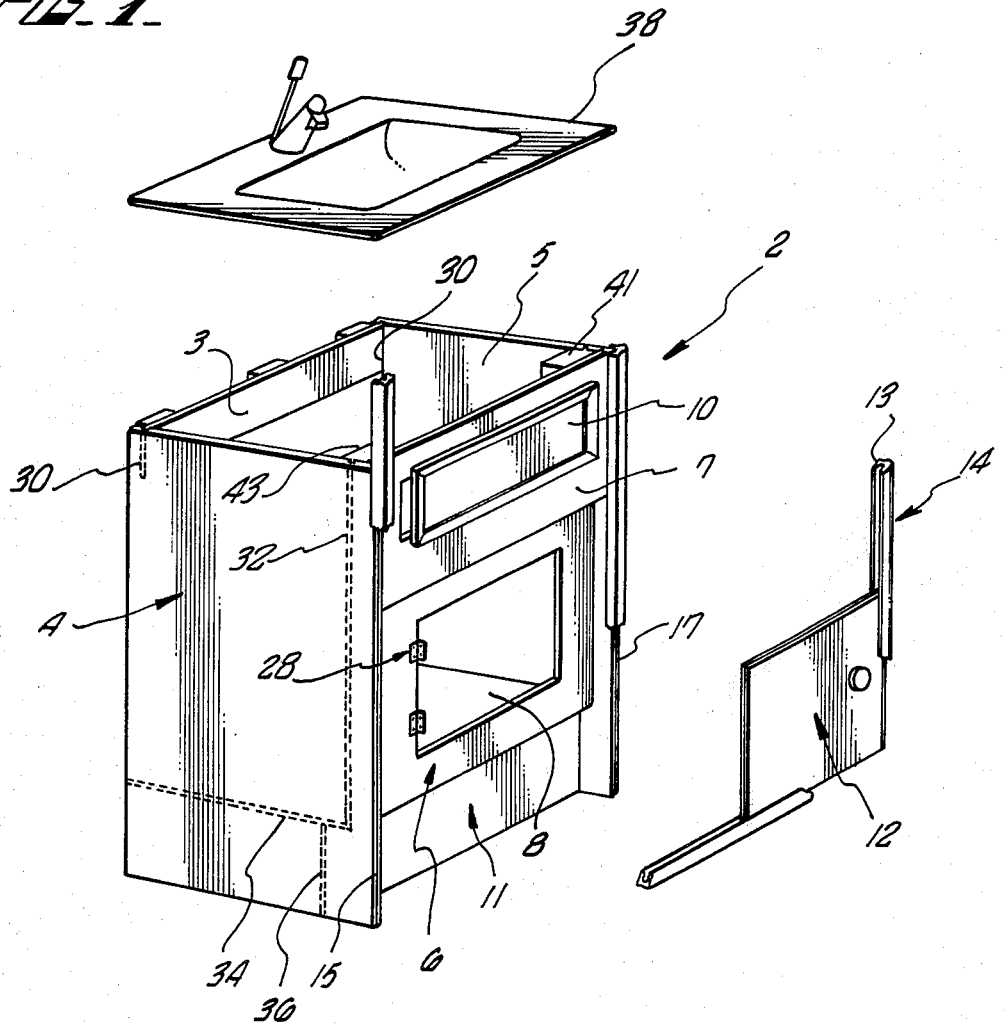
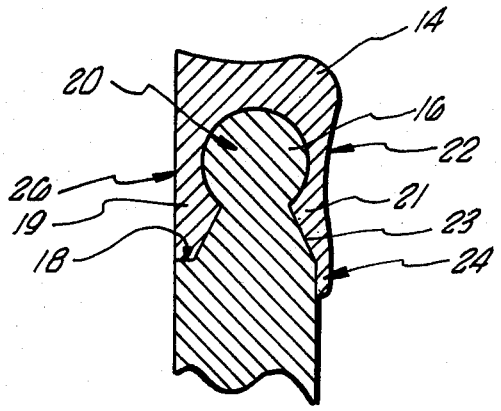
FIG. 2
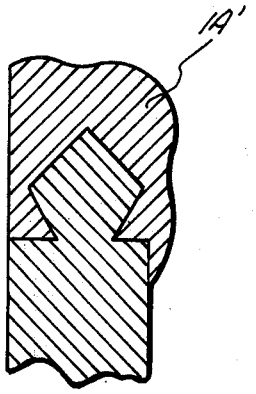
FIG. 3

FIG. 4
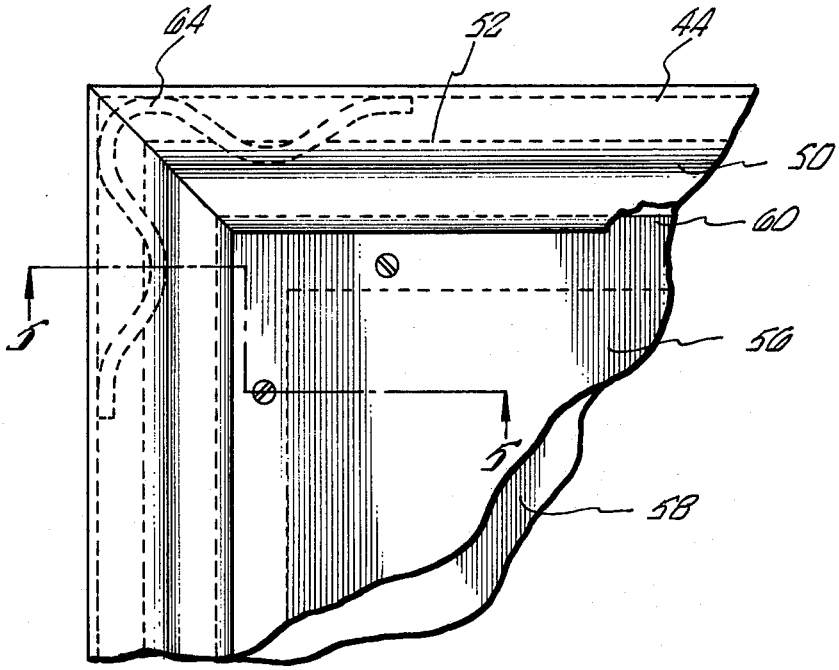
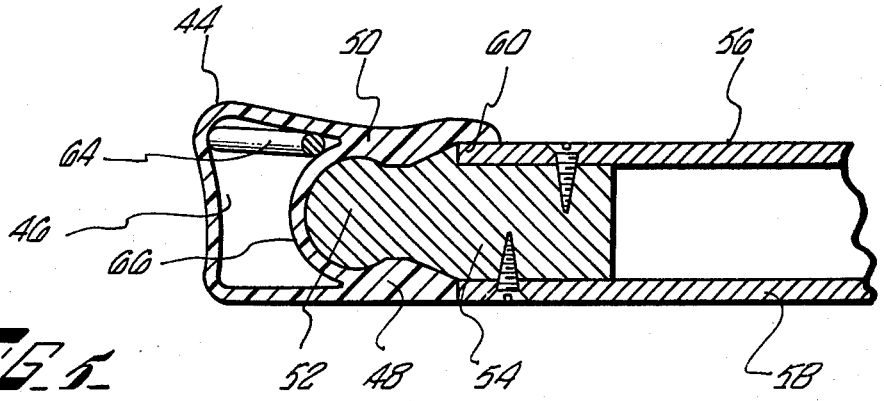
FIG. 5
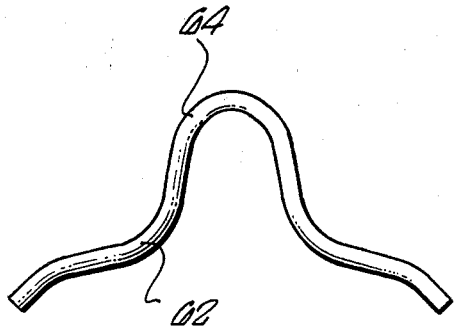
FIG. 6
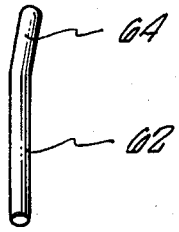
FIG. 7

MOLDING FOR CABINETS AND DOORS

BACKGROUND OF THE INVENTION

1. Related Applications

The present invention is a continuation-in-part application of allowed U.S. patent Ser. No. 313,775 filed Dec. 11, 1972.

2. Field of the Invention

The present invention relates to cabinet assemblies, hollow doors and other furniture and more particularly, to an economic molding design and application.

3. Description of the Prior art

The cabinet making art has gradually over the years relied to a greater extent upon cabinet construction that can be shipped in an unassemblied or do-it-yourself manner. In addition, cabinets have been provided so that the component parts can interlock with each other with a minimal use of conventional fastening components such as nails, screws, glue, doweling, etc. Generally, these prefabricated cabinet assemblies eliminate the large volume requirements in conventional assembly transportation and storage and provide a rapid and easy assembly at their ultimate destination. Examples of such furniture are numerous and include bookcases, desks, chests of drawers, kitchen cabinets, bathroom cabinets, etc.

Examples of various cabinet assemblies in the prior art include the Mitchell U.S. Pat. No. 3,021,187, Oldford U.S. Pat. No. 3,379,483, Campbell U.S. Pat. No. 305,286 Campbell U.S. Pat. No. 419,920, Gardner U.S. Pat. No. 3,239,891, Roggio, Jr. et al U.S. Pat. No. 3,523,716 and Schulte U.S. Pat. No. 3,697,147.

Usually doors and related structures have been formed from solid wood or relatively heavy metal frames. Recently, there has been a demand for relatively light weight doors having sufficient strength so as to function satisfactorily in the intended manner, for example, interior doors and doors for boats and recreational vehicles. An example of this type of door can be found in the Mock U.S. Pat. No. 3,426,482.

Recently, wood panels have been formed from granular or small wood pieces that are pressed together with appropriate adhesives to form sheets of wood. Frequently, these panels are referred to as particle boards, chip boards, flake boards, etc. A commercial example is the NOVA PLY sold by U.S. Plywood Corp. This form of panel sheeting is highly advantageous in terms of cost and surface quality for cabinet making; however, the fiber nature of the board presents irregular surfaces when machined that are particularly prone to chip or present an undecorative appearance. Attempts have been made to fill the irregular edge surfaces by caulking and other methods but this is relatively expensive and frequently inadequate in providing an acceptable decorative surface

SUMMARY OF THE INVENTION

The present invention provides a molding that permits cabinet assembly to utilize a wood panel such as a pressed fiber board sheet of wood with a minimum of wastage. The panels of the cabinet assembly can utilize a key hole tongue end for connection with appropriate grooves in molding configuration. The molding strip can be slid or snapped onto the perimeter of a panel member or a cut out blank of the panel to provide both a decorative and utilitarian function. The molding strip presents a pleasing surface and protects the fiber board from further chipping while in addition permits the use of cut out blanks for features such as doors and the like without any wastage of material. The molding strip provides a decorative surface on the top and front and a flat surface on the rear to provide a continual interfacing plane with a panel or cut out blank surface. In addition, the molding strip can be utilized to form a hollow panel or door.

The features of the present invention which are believed to be novel are set forth with particularity in the appended claims. The present invention, both as to its organization and manner of operation, together with further objects and advantages thereof, may best be understood by reference to the following description, taken in connection with the accompanying drawings.

BRIEF DESCRIPTION OF THE DRAWINGS

FIG. 1 is an exploded perspective view of a cabinet assembly using the molding strip of the present invention;

FIG. 2 is a cross sectional view of the molding strip and panel edge in accordance with the present invention; FIG. 3 is a cross sectional view of an alternative molding strip and panel edge in accordance with the present invention;

FIG. 4 is a partial plan view of a hollow door;

FIG. 5 is a cross sectional view taken along line A—A of FIG. 4;

FIG. 6 is a plan view of a spring clip; and

FIG. 7 is a side view of the spring clip.

DESCRIPTION OF THE PREFERRED EMBODIMENT

Referring to FIG. 1, a cabinet assembly 2 is presented wherein the individual panels can be interconnected together by the coaction of respective key hole or dovetail tongues and complementary grooves on the panels. The panels can be made from pressed fiber panels. The rear panel or strong back 3 has dovetail tongue edges on both of its sides. Complementary grooves or rear side slots 30 are positioned on side panels 4 and 5 for interengaging and locking the rear panel 3 in a predetermined position.

Similarly, a front panel 6 and a bottom panel 8 have side key hole or dovetail tongue edges that coact with complementary bottom side slots 34 and front side slots 32. A lower panel side slot 36 extends upward from the bottom of each of the side panels 4 and 5 and receives a front lower panel 11 with appropriate tongue configuration edges. Likewise, an upper panel 7 having rear cleats 41 and 43 extends downward from the upper portion of the side panels 4 and 5.

During assembly, as can be seen in FIG. 1, the particular panels with the tongues are positioned in the appropriate slots. Adhesive or glue or other fasteners can optionally be utilized to strengthen the interlocking cabinet assembly 2.

The front edges 15 and 17 of the respective side panels 4 and 5 have similar cross sectional key hole tongue configurations as disclosed in FIG. 2 or FIG. 3. Molding 14 is designed to accommodate the bulbous head 20 of the panel key hole shaped tongue 16 and to further provide an outside decorative contour surface 22. The molding 14 is preferably made of a resilient material such as plastic or hard rubber and has the characteristic of being capable of either sliding or snapping onto the panel tongue 16. The top and front surface of the molding 14 has a decorative contour surface 22 while a rear surface 26 is preferably flat and lies in the same plane as the surface of the panel member. The key hole shaped tongue 16 of the fiber board panel member is preferably offset, for example, an eighth of an inch on a ½ inch panel to provide a support shoulder 18 for receiving the base of the rear leg member 19 of the molding 14. This insures both a stable fit and permits the resultant door or panel to fit flush against a cabinet panel. The panel member will accordingly have an enlarged peripheral surface on one side of the tongue 16 relative to the other side.

The front leg member 21 of the molding 14 terminates in an overlapping lip 24 that extends below the cut interface or sloping surface 23 of the tongue base. This feature insures that any irregularities of the cut will not be seen when the molding 14 is in place. This is of particular importance when dealing with pressed fiber board since the cut surface is frequently irregular and prone to chipping and pits at the interface of the panel surface and the tongue portion.

The shorter leg portion 19 of the molding strip member 14 abuts against the enlarged peripheral surface adjacent the bulbous head 20 and has a corresponding complementary surface configuration. The shorter leg portion 19 has an outside surface lying in a plane approximately parallel to a plane containing the surface of the panel 14 and preferably in the same plane.

Of particular advantage in the present invention, is the ability to utilize the molding strip 14 to conserve panel material by permitting the panel members such as the front panel 6 and the upper panel 7 to have one or more doors 12 and decorative panels 10 added to these panels without resorting to additional sheets of material. It has generally been necessary in the prior art to have the door member or decorative panel cut from an additional sheet of panel material to permit an overlapping over the frame sheet as in the case of the decorative panel 10 or over the opening in the panel in the case of the door 12. With the present invention, the door 12 can be cut directly from the front panel 6 and with the addition of flexible elongated molding strips 14 having 45 degree angular ends 13 it is possible to effectively enlarge the cut blank door to permit its use as a door on the same panel member from which it was cut. Likewise, a decorative panel 10 with appropriate molding 14 can also be produced from the same upper panel member 7 without resorting to an additional sheet of material.

As can be easily understood, this also permits an easy packaging of the cabinet assembly in a compact form by simply cutting the blank door 12 or decorative panel 10 and letting it remain within the panel sheet from which it was cut.

As can be readily understood by those familiar with cutting out component parts in cabinet assemblies, the cutting of a door or decorative panel from a sheet of material especially fiber board, will produce both jagged edges and a gap of approximately one eighth of an inch or more about the perimeter of the resulting blank and panel. As a result, it has been necessary to cut one panel member to act as a frame for a door or for a decorative panel and then to resort to a second panel member to cut a slightly larger door blank to achieve the desired decorative effect required in modern cabinet assemblies.

The molding strips 14 of the present invention remove this wastage and permits the same panel sheet to provide either the decorative panel or the appropriate door with the simple addition of the molding 14 to the cut out blank. As can be seen in FIGS. 1 and 2, the molding 14 is positioned about the entire perimeter of the door blank 12 with the decorative contour surface 22 on the outside and the door blank 12 can be attached to appropriate hinges 28 to complete the assembly. Likewise, the decorative panel 10 will have the molding 14 positioned about its entire perimeter and the decorative panel 10 is then permanently attached over the cut blank opening in the upper panel member 7.

The particular offsetting of the key hole tongue 16 and its bulbous head 20 provides the step shoulder 18 that permits the molding 14 to be securely fastened. This offset connecting configuration with the rear surface of the molding in the same plane as the rear panel face is particularly adapted to the fitting of the blanks such as the door 12 and the decorative panel 10 in a flush manner with the face or surface of the respective panels 6 and 7. The overlapping lip 24 of the molding 14 insures that the ornamental feature of the door 12 or the decorative paneling 10 will not be marred by any discontinuities along the interface between the sloping edge 23 of the base of the key hole tongue 16 and the surface of the panel member.

As seen in FIG. 3, the connecting configuration between the peripheral edge and the molding 14′ can be modified from that shown in FIG. 2 to have a somewhat diamond cross sectional shape. Other configurations are possible within the scope of the invention.

As disclosed in FIG. 1, a cabinet is provided for use in a bathroom or kitchen adpated to receive a sink member 38 across its top. However, it should be realized that this is for illustrative purposes only and various forms of cabinet assembly can benefit from the present invention.

Referring to FIG. 5, an alternative use of the molding is disclosed for producing hollow panels or hollow doors. The elongated flexible molding strip 44 is modified from the embodiments disclosed in FIG. 2 and FIG. 3 by the provision of an upper hollow chamber or cavity 46. The cavity 46 promotes the flexibility of the respective leg portions 48 and 50 to further facilitate a snap-on or sliding movement. The shorter leg portion 48 of the molding strip member 44 abuts against the enlarged peripheral surface adjacent a bulbous head 52 of a frame strip 54. The frame strip 54 has a cross sectional key hole configuration as can be seen in FIG. 5.

Appropriately attached to the frame strip 54 are front and rear decorative panels 56 and 58 respectively. As can be appreciated the individual side frame strips 54 will have 45 degree sloping ends adapted to interface with similar strips to form a square or rectangular configuration of the appropriate size. In the preferred embodiment, the frame strips 54 are adapted to receive the front panel 56 along an undercut or shoulder 60 as disclosed in FIG. 5.

A spring clip 62 having a sinusoidal shape is appropriately bent to form a right angle configuration of substantially a U shape. Clip 62 is made of metal or other rigid material and has the characteristic of being relatively resilient. By appropriately inserting the spring clip 62 within the interior cavity 46 of two adjacent molding strips 44 they are held relative to each other and are strenghened adajcent their corner edges. The preferred configuration of the spring clip 62 can be seen in FIG. 6 and FIG. 7. With particular reference to FIG. 7, the upper head or center portion 64 of the spring clip is bent so that its longitudinal axis forms a slight angle with the plane of the spring clip base 66. The spring clip 62 provides a compressive force on the molding strips 44 by exerting pressure adjacent the outermost peripheral edge or corner of the respecting molding strips 44 and also along the contact point of the spring clip base 66 with the concave inner walls 66 of the respective molding cavities 46. The edge or side of the concave interior walls 66 forms a seat for the spring clip 62.

In assembling a hollow door or panel the frame strips 54 are appropriately connected to a front panel 56 and a rear panel 58. The molding strips 44 can then be snapped or slid on to the bulbous head 52 of the frame strip 54. The leg portion 50 of the molding strip 44 will extend across the interface of the front panel 56 and the shoulder 60. Thus, any discontinuities along the interface will not mar the ornamental effect of the front of the door or hollow panel. The spring clip 62 can be appropriately positioned within the interior cavities 46 of adjacent molding strip 44. If desired, adhesive material can be optionally added to strengthen the assembly.

As can be readily appreciated, it is possible to deviate from the above embodiments of the present invention and it will be readily understood by those skilled in the art that the invention is capable of many modifications and improvements within the scope and spirit thereof. Accordingly, it will be understood that the invention is not to be limited by the specific disclosed embodiment but only by the scope and spirit of the appended claims.

What is claimed is:

1. In a construction assembly such as cabinets, shelves, doors and the like formed from a plurality of members such as wood particle boards with at least one decorative surface and an enlarged locking head edge portion adjacent the decorative surface with at least one support shoulder adjacent the base of the locking head, the improvement comprising:

a flexible molding member assembly including an elongated flexible body member mounted over the enlarged locking head edge portion;

a pair of resilient relatively parallel leg portions movable relative to each other and extending from the body member, one leg portion being longer than the other and extending beyond the base edge portion of the locking head to overlap the decorative surface of the board member, the other shorter leg portion terminating in a shoulder abutting the support shoulder of the board member, the surface of the shorter leg portion being planar and not extending substantially beyond the plane containing the adjacent surface of the board member; and means connected to the flexible body member between the outside surfaces of the parallel leg portions for gripping the locking head adjacent its base on either side.

2. A molding member as in claim 1 wherein a central circular groove extends through the molding member body and a sloping surface extends from the circular groove on each leg portion to respectively the shoulder portion and the overlap portion, the surface of the shorter leg portion adapted to lie in the same plane as the adjacent object surface.

3. A molding member as in claim 1 wherein a central groove having a cross sectional diamond-like shape extends through the molding member, the surface of the shorter leg portion adapted to lie in the same plane as the adjacent object surface.

4. A molding member as in claim 1 wherein the elongated body member is hollow and has at least one decorative outside surface.

5. In a construction assembly such as cabinets, shelves, doors and the like formed from a plurality of members such as wood particle boards with at least one decorative surface and an enlarged locking head edge portion adjacent the decorative surface with at least one support shoulder adjacent the base of the locking head, the locking head edge portion extending at least along two contiguous edges of the board member, the improvement comprising:

a flexible molding member assembly including at least a pair of elongated hollow flexible body members mounted over the enlarged locking head edge portions of the contiguous edges of the board member;

a pair of resilient relatively parallel leg portions movable relative to each other and extending from the body members, one leg portion being longer than the other and extending beyond the base edge of the locking head to overlap the decorative surface of the board member, the other shorter leg portion terminating in a shoulder abutting the support shoulder of the board member, the surface of the longer leg portion extending beyond the plane of the decorative surface of the board member, the surface of the shorter leg portion being planar and not extending substantially beyond the plane containing the adjacent surface of the board member;

means connected to the flexible body member between the outside surfaces of the parallel leg portions including inwardly protruding members on the leg portions for gripping the locking head adjacent its base on either side; and a spring member inserted within the hollow flexible body members to bias them together.

6. A molding member as in claim 5 wherein the spring member has a substantially U shape.

7. A molding member as in claim 5 further including a frame strip having a cross sectional key hole configuration.

8. A molding member as in claim 5 wherein the interior wall of the hollow body member between the leg portions is concave relative to the ends of leg portions to increase the resiliency of the leg portions.

9. A molding member as in claim 6 wherein the center portion of the spring member is bent so that its longitudinal axis forms a slight angle with a plane containing the remaining portion of the spring member.

10. A molding member as in claim 8 wherein one side of the concave interior wall forms a seat for the spring member.

* * * * *